US009556716B2

(12) United States Patent
Kirkpatrick

(10) Patent No.: US 9,556,716 B2
(45) Date of Patent: Jan. 31, 2017

(54) TEMPORARY SUPPORT FOR ELECTRIC SUBMERSIBLE PUMP ASSEMBLY

(71) Applicant: Baker Hughes Incorporated, Houston, TX (US)

(72) Inventor: Charles Thomas Kirkpatrick, New Caney, TX (US)

(73) Assignee: Baker Hughes Incorporated, Houston, TX (US)

( * ) Notice: Subject to any disclaimer, the term of this patent is extended or adjusted under 35 U.S.C. 154(b) by 826 days.

(21) Appl. No.: 13/870,398

(22) Filed: Apr. 25, 2013

(65) Prior Publication Data

US 2014/0318813 A1 Oct. 30, 2014

(51) Int. Cl.
*E21B 43/12* (2006.01)

(52) U.S. Cl.
CPC ..... *E21B 43/128* (2013.01)

(58) Field of Classification Search
CPC ..... E21B 43/128; E21B 43/14; E21B 43/00; E21B 34/12; E21B 34/00; E21B 34/08
See application file for complete search history.

(56) References Cited

U.S. PATENT DOCUMENTS

| | | | | |
|---|---|---|---|---|
| 5,213,159 | A * | 5/1993 | Schneider | E21B 34/14 166/250.07 |
| 6,168,388 | B1 * | 1/2001 | Hughes | E21B 43/124 166/105 |
| 6,179,056 | B1 * | 1/2001 | Smith | E21B 43/121 166/105.5 |
| 7,048,057 | B2 * | 5/2006 | Bearden | E21B 43/128 166/105 |
| 2011/0136707 | A1 | 6/2011 | Xu et al. | |
| 2014/0000864 | A1 * | 1/2014 | Fielder, III | E21B 43/128 166/65.1 |

* cited by examiner

*Primary Examiner* — Blake Michener
*Assistant Examiner* — Wei Wang
(74) *Attorney, Agent, or Firm* — Steve Rosenblatt

(57) ABSTRACT

The need to have the housing of an ESP suspended by the discharge flange to allow room for downhole thermal expansion in a situation where there is no surface access to the lower end of the ESP when the discharge flange is bolted up is addressed by building the ESP on a support that is removable downhole without intervention. A controlled electrolytic material or CEM can be used or other materials that meet the structural support requirement for the ESP and then after a predetermined time lose their capacity to support leaving the ESP suspended by its discharge flange and capable of growing under thermal loading.

14 Claims, 1 Drawing Sheet

TEMPORARY SUPPORT FOR ELECTRIC SUBMERSIBLE PUMP ASSEMBLY

FIELD OF THE INVENTION

The field of the invention is electric submersible pumps (ESP) and more particularly a way of allowing long assemblies to be hung from the pump discharge in long assemblies where access to the lower end of the ESP is not available after assembly.

BACKGROUND OF THE INVENTION

ESPs are assembled on a rig floor and the overall length of the assembly varies with the application. There is a direct relationship between the required output pressure and the length of the assembly. In the past these pumps have been used in shallow wells where the overall length was within the limits of surface equipment to suspend and still allow access to the bottom of the finished assembly that was accessible at or above the rig floor. More recently the applications have been in deeper wells requiring additional stages for the ESP and getting the overall length of the ESP assembly to the order of 100 meters or more. The surface equipment cannot suspend assemblies that are this long outside the wellhead.

In some applications the ESP is assembled on a parallel orientation to the tubular string going into the well using a Y-connection assembly. This assembly allows the ESP to be positioned parallel to the string so that tools can go straight through the string while the ESP is in essence on a sidetrack. The preferred way to mount the ESP is to use the upper Y-connection to suspend the weight of the ESP. When this is done there is room for thermal expansion when downhole without putting any compressive stresses on the ESP housing. In shorter assemblies the way this is done is that there is a Y-connector uphole and a pup joint below the pump with an extending pedestal aligned with the flange connection on the upper Y-connector. The pump is built up on the extending pedestal that has an available axial adjustment. The pump is normally fully assembled in the derrick on the bottom support and then the height of a telescoping joint near the Y-connection is adjusted so that the mating flange on the Y-connector comes down to the discharge flange of the ESP. After the flanged connection is bolted up at the top of the ESP, and the telescoping joint is locked, the adjuster at the bottom, which is still accessible on the rig floor, is backed off to allow the ESP to be suspended by its housing from its discharge flange that is bolted to the Y-connector. In this manner the housing has room to grow due to thermal loading once lowered into the borehole.

The problem arises when the length of the ESP is such that its lower end that rests on the extending pedestal is already in the hole when the upper end of the pump is assembled. While the Y-connector can be brought down to allow bolting up the discharge flange of the ESP there is no longer any access to the lower end of the ESP to remove the lower support as was done before with shorter assemblies that left the lower end accessible on the rig floor. Because of the tight fit of the parallel ESP and main string in the wellbore and the fact that the ESP and the adjoining tubular are secured to each other with fasteners as the ESP is assembled, there is no longer a way to raise the ESP far enough to get its weight to hang off the discharge flange.

The present invention addresses this issue by eliminating the need to raise the ESP when its lower end is on a pedestal in the wellbore while still putting the ESP in a condition where its weight hangs off the discharge flange to allow room for thermal expansion. Instead the pedestal comprises an interventionless removable support so that the ESP can be assembled as before with the shorter versions and then run in the hole at which point the support already in the hole would be undermined shifting the hanging weight of the ESP to the Y-connector. In the preferred embodiment the temporary support is a controlled electrolytic material as described in US Publication 2011/0136707 and related applications filed the same day. These and other aspects of the present invention will become more readily apparent from a review of the description of the preferred embodiment and the associated drawings while recognizing that the full scope of the invention is to be determined by the appended claims.

SUMMARY OF THE INVENTION

The need to have the housing of an ESP suspended by the discharge flange to allow room for downhole thermal expansion in a situation where there is no surface access to the lower end of the ESP when the discharge flange is bolted up is addressed by building the ESP on a support that is removable downhole without intervention. A controlled electrolytic material or CEM can be used or other materials that meet the structural support requirement for the ESP and then after a predetermined time lose their capacity to support leaving the ESP suspended by its discharge flange and capable of growing under thermal loading.

DETAILED DESCRIPTION OF THE PREFERRED EMBODIMENT

Figure 1:
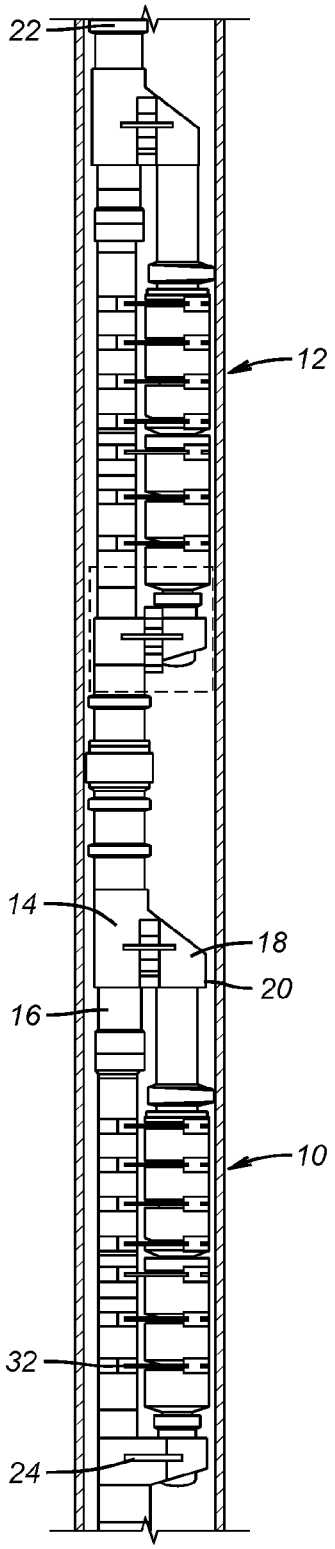
FIG. 1 is an assembly of an upper and lower ESP in a wellbore.
Figure 2:
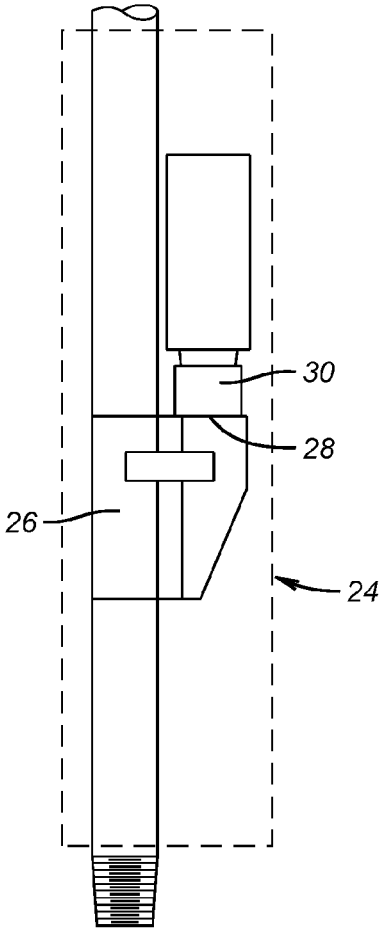
FIG. 2 is the view of the lower ESP support for each ESP showing the temporary support that stops supporting in the wellbore without intervention.

FIG. 1 shows a lower ESP 10 and an upper ESP 12. A Y-connector 14 has an adjacent selectively lockable telescoping joint 16 that allows axial manipulation of flange 18 on the branch of the Y-connector 14 to be lowered to the mating flange 20 on the lower ESP 10. String 22 goes straight through and the ESP 10 and 12 are in a generally parallel orientation to the string 22 so that tools can pass through the string 22 and the discharge of the ESP 10 or/and 12 can be in fluid communication with the string 22 as well. A support assembly 24 is shown in greater detail in FIG. 2. There is a clamp portion 26 around string 22. The clamp 26 supports a support surface 28 above which sits a removable support 30. The support 30 presents an initial stable and preferably flat surface on which the modular ESP can be built up in sections and run in the hole as it is being built up with an adjacent portion of the string 22. The support 30 can be attached to the support surface 28 or it can just sit on it. As the ESP 10 is assembled bands 32 can be used to pull the ESP 10 toward the string 22 to narrow the profile of the sting 22 with the ESP 10 for introduction into a wellbore. The bands 32 can be on any desired spacing and are for the purpose of stability of the ESP plus reduction of the assembly profile to facilitate insertion. There is normally enough slack in the bands 32 so that when the support 30 goes away or is structurally undermined without well intervention the weight of the ESP 10 will be hanging substantially from flange 18. This is the desired result as there will be thermal loading on the ESP 10 due to well temperatures and the hanging orientation of the ESP 10 will allow room for thermal expansion.

The support 30 is preferably a controlled electrolytic material (CEM) that with sufficient exposure to well fluids will weaken to the point that it will no longer lend support. Other materials that lose their structural integrity over time are also contemplated as are materials that change shape to the extent that they no longer support the bottom of the ESP 10. Such materials can be a shape memory alloy that after exposure to temperatures above the critical temperature reverts to another shape and moves out of contact with the ESP 10 despite any length changes of the ESP 10 due to the same thermal effects. In other alternatives there can be a heat source in or adjacent the support 30 that can be triggered remotely when the ESP 10 is fully assembled or it can be triggered with a timer to create heat and undermine the support 30. In another variation a chemical can be released into the support 30 or a chemical already inside the support 30 but enclosed in a cover can be released by causing the cover to fail. Common to all these techniques is to allow enough time on a temporary support for the entire ESP 10 to be assembled and bolted up at its discharge flange 20 so that the removal or incapacitation of the support 30 will have the ESP 10 supported from its discharge flange 20 with available room for thermal expansion. It should be noted that bands 32 serve the primary purpose of bringing the ESP 10 toward the adjacent tubular string 22. While the bands 32 are relatively loose fitting so that the ESP 10 hangs by its upper end when the support 30 is undermined, there is not normally enough slack to be able to lift the entire ESP which can be about 100 meters long or more high enough to allow the room for thermal expansion that would be needed for the ESP 10 without putting its housing under undesirable compressive stress. Accordingly, the support 30 has a suitable height so that when the support 30 is undermined the ESP 10 is unsupported at its lower end and has enough clearance for thermal expansion without hitting a fixed support.

Those skilled in the art will appreciate that the same factors apply to ESP 12 as described above with ESP 10 and any additional ESPs that may be supported by the string 22. With the lower end of each ESP not accessible from the surface after assembly of the ESP due to new lengths of 100 meters or more, simply trying to raise the ESP from an upper end as done before with very much shorter ESPs will no longer work. The banding between the adjacent string and the ESP prevents raising the ESP enough to allow sufficient room for later thermal expansion. The support below the ESP being in the well is no longer physically accessible and cannot be manually removed. Accordingly, the present invention provides the ability to support the ESP after assembly from its discharge flange at it rests on an inaccessible bottom support that is later, after assembly and support of the ESP from its discharge flange, removed in a variety of ways to the extent that the ESP will then have room for expansion while its weight is supported off its discharge flange.

The above description is illustrative of the preferred embodiment and many modifications may be made by those skilled in the art without departing from the invention whose scope is to be determined from the literal and equivalent scope of the claims below:

I claim:

1. An assembly method for at least one electric submersible pump (ESP) disposed adjacent a tubular string for use in a subterranean location, comprising:

attaching at least one support to outside the string at a surface location;

building said string while building said at least one ESP on said at least one outside support at the surface location;

finishing building said ESP at the surface location with said outside support located in a borehole;

securing said ESP to the string at an upper end thereof outside the borehole;

continuing to build said string for positioning said ESP at a predetermined subterranean location;

undermining said outside support after said positioning to allow room for said ESP to respond to thermal loads when fully delivered into the borehole.

2. The method of claim 1, comprising:

using a y-connector for said securing said ESP to said string.

3. The method of claim 2, comprising:

bringing said y-connector to a discharge connection on said ESP with a telescoping connection.

4. The method of claim 3, comprising:

locking said telescoping connection after securing the ESP to the y-connector.

5. The method of claim 1, comprising:

using a controlled electrolytic material as at least a part of said outside support;

exposing said material to well conditions to undermine said material from supporting the weight of said ESP.

6. The method of claim 1, comprising:

undermining said support by melting said support with heat.

7. The method of claim 6, comprising:

providing a source of heat within said support.

8. The method of claim 1, comprising:

using a shape memory alloy for at least a part of said outside support;

bringing said alloy beyond its critical temperature in the borehole;

changing the shape of said alloy so that said ESP is no longer supported by said outside support.

9. The method of claim 1, comprising:

assembling said ESP to a length of at least 100 meters.

10. The method of claim 1, comprising:

providing a plurality of axially spaced ESPs with each supported from a discrete outside support.

11. The method of claim 1, comprising:

undermining said outside support with a chemical reaction.

12. The method of claim 11, comprising:

adding at least one reactant to the borehole for said undermining.

13. The method of claim 11, comprising:

selectively containing at least one reactant in said outside support;

undermining said outside support by release of said reactant.

14. The method of claim 1, comprising:

triggering said undermining on an elapsed time basis.

* * * * *